US011220731B2

(12) United States Patent
Seong et al.

(10) Patent No.: US 11,220,731 B2
(45) Date of Patent: Jan. 11, 2022

(54) HOT-ROLLED COATED STEEL SHEET WITH EXCELLENT WORKABILITY AND MANUFACTURING METHOD THEREFOR

(71) Applicant: POSCO, Pohang-si (KR)

(72) Inventors: Hwan-Goo Seong, Gwangyang-si (KR); Seong-Beom Bae, Gwangyang-si (KR)

(73) Assignee: POSCO, Pohang-si (KR)

( * ) Notice: Subject to any disclaimer, the term of this patent is extended or adjusted under 35 U.S.C. 154(b) by 765 days.

(21) Appl. No.: 16/065,321

(22) PCT Filed: Dec. 23, 2016

(86) PCT No.: PCT/KR2016/015145
§ 371 (c)(1),
(2) Date: Jun. 22, 2018

(87) PCT Pub. No.: WO2017/111518
PCT Pub. Date: Jun. 29, 2017

(65) Prior Publication Data

US 2020/0399746 A1 Dec. 24, 2020

(30) Foreign Application Priority Data

Dec. 24, 2015 (KR) ..... 10-2015-0186127

(51) Int. Cl.
*C22C 38/14* (2006.01)
*C21D 8/02* (2006.01)
(Continued)

(52) U.S. Cl.
CPC ..... *C22C 38/14* (2013.01); *C21D 8/0205* (2013.01); *C21D 8/0226* (2013.01);
(Continued)

(58) Field of Classification Search
None
See application file for complete search history.

(56) References Cited

U.S. PATENT DOCUMENTS

2002/0148536 A1 10/2002 Nakajima et al.
2013/0266821 A1 10/2013 Kawasaki et al.

FOREIGN PATENT DOCUMENTS

CN 102041435 5/2011
CN 103882343 6/2014
(Continued)

OTHER PUBLICATIONS

Machine Translation of KR-20150007608-A (Year: 2015).*
(Continued)

*Primary Examiner* — Paul A Wartalowicz
*Assistant Examiner* — Ryan L Heckman
(74) *Attorney, Agent, or Firm* — Cantor Colburn LLP

(57) ABSTRACT

Provided is a hot-rolled coated steel sheet having a yield point elongation of less than 4% and a manufacturing method for the same. The hot-rolled steel sheet comprises, by weight, 0.03 to 0.06% of carbon (C), 0.5 to 1.5% of manganese (Mn), 0.01 to 0.25% of silicon (Si), 0.01 to 0.05% of aluminum (Al), 0.001 to 0.02% of phosphorus (P), 0.006% or less of sulfur (S), 0.0001 to 0.02% of titanium (Ti), 0.0001 to 0.03% of niobium (Nb), 0.001 to 0.005% of nitrogen (N), and a balance of iron (Fe) and inevitable impurities, wherein the Ti, Al and N satisfy the following relationship 1, and the Nb, C and N satisfy the following
(Continued)

relationship 2: $0.03 \leq (\text{wt \% Ti}) \times (\text{wt \% Al}) \times (\text{wt \% N}) \times 10^6 \leq 0.20$ (1), and $22 \leq (\text{mol \% Nb}) / \{(\text{mol \% C}) \times (\text{mol \% N})\} \leq 1826$ (2).

8 Claims, 5 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C23C 2/02*** | (2006.01) |
| ***C23C 2/06*** | (2006.01) |
| ***C23C 2/12*** | (2006.01) |
| ***C23C 2/40*** | (2006.01) |

(52) U.S. Cl.

CPC ..... *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C23C 2/02* (2013.01); *C23C 2/06* (2013.01); *C23C 2/12* (2013.01); *C23C 2/40* (2013.01); *C21D 2211/005* (2013.01)

(56) References Cited

FOREIGN PATENT DOCUMENTS

| | | |
|---|---|---|
| JP | 05117834 | 5/1993 |
| JP | 07157840 | 6/1995 |
| JP | 09263883 | 10/1997 |
| JP | 2000178684 | 6/2000 |
| JP | 4006112 | 11/2007 |
| JP | 2009041104 | 2/2009 |
| KR | 19910003029 | 5/1991 |
| KR | 20020016906 | 3/2002 |
| KR | 20130025961 | 3/2013 |
| KR | 20140081599 | 7/2014 |
| KR | 20150007607 | 1/2015 |
| KR | 20150007608 | 1/2015 |
| KR | 20150007608 A * | 1/2015 |

OTHER PUBLICATIONS

Marder, A.R. "The Metallurgy of Zinc-Coated Steel." Progress in Materials Science, vol. 45, No. 3, 2000, pp. 191-271 (Year: 2000).*

Chinese Office Action—Chinese Application No. 201680076209.3 dated Jul. 23, 2019, citing JP9-263883, KR10-2015-0007608, CN102041435, CN103882343, JP4006112, JP5-117834 and KR10-1485271.

* cited by examiner (a)

(b)

(a)

(b)

(a)

(b)

(a)

(b)

(a)

(b)

HOT-ROLLED COATED STEEL SHEET WITH EXCELLENT WORKABILITY AND MANUFACTURING METHOD THEREFOR

TECHNICAL FIELD

The present disclosure relates to a hot-rolled coated steel sheet with excellent workability and manufacturing method therefor.

BACKGROUND ART

It is a general trend in the automotive industry to increase efficiency of automobile fuel consumption by applying a high strength thin steel sheet to exterior/interior panel and chassis components of an automobile, to reduce a total weight of the automobile. In particular, since an usage of a hot-rolled thin steel sheet (hereinafter referred to as a hot-rolled thin steel sheet) as a material for automobile parts is gradually increasing, standards for improvements of the hot-rolled thin steel sheets, and for increases in dimension and corrosion resistance have become more stringent. In the case of a hot-rolled thin steel sheet having a high degree of dimensional accuracy, corrosion resistance of the hot-rolled thin steel sheet itself has been increased, or the hot-rolled thin steel sheet has been coated to improve corrosion resistance.

On the other hand, a hot-rolled thin steel sheet may have problems in which the straightness of the steel sheet during hot rolling may be not easily controlled, and productivity thereof may be reduced due to a shrinkage of the rolling sheet, including twisting or breaking of the steel sheet. Endless rolling techniques are known in the related art to be required to be applied in terms of a shape, a dimension and uniformity of materials.

According to Patent Document 1 (Japanese Unexamined Patent Application Publication No. 2009-041104), a steel having a weight ratio of N/Al of 0.3 or more was subjected to finish rolling by lubrication rolling using an endless rolling technique (after bar-plate bonding, Tandem rolling-coiling is directly connected), to provide a thin steel sheet having a uniform material with a minimum temperature variation in the width direction of the steel sheet, and a method of improving a bake hardening property of 80 MPa or more. An aluminum (Al) content was controlled by increasing a nitrogen (N) content in a matrix, to increase the hardening capacity after a paint baking treatment (170° C., 20 min). Then, rapid cooling at a cooling rate of 40° C./sec or more and low temperature coiling were undertaken to significantly reduce a deposition of carbide/nitride including AlN. It also suggested that a ratio Mn/Si in the range of 3 or more was required to control the transformation temperature that may affect a shape of the thin steel sheet. The document described ferrite and martensite as main phases of a microstructure.

According to Patent Document 2 (Korean Patent Laid-Open Publication No. 10-2002-0016906), a cold-rolled (annealed) thin steel sheet having a high press formability was disclosed, comprising a steel containing at least one of 0.002 to 0.02% of C, 1% or less of Si, 3.0% or less of Mn, 0.1% or less of P, 0.01 to 0.1% of Al, 0.007% or less of N, 0.01 to 0.4% of Nb and 0.005 to 0.3% of Ti controlled in (12/93) Nb/C (ratio of atomic weight) to be 1.0 or more, to eliminate an occurrence of uneven elongation (YP-elongation). On the other hand, the characteristic that the non-uniform deformation is "zero" through control of a weight ratio of (12/93) Nb/C 1 may be realized by significantly reducing the carbon content concentrated in ferrite grain boundaries by adding elements of a carbide/nitride to a low carbon steel.

When a yield point elongation occurs on a hot-rolled steel sheet, and a surface defect is generated, a thickness of a rolled steel sheet becomes uneven, especially, in a cold rolling process, and the steel sheet surface becomes defective. Therefore, this case may not be applied to be used as an exterior panel of an automobile.

According to Patent Document 3 (Korean Patent Examined Publication No. 1991-0003029), a steel containing 0.2% or less of C and 2% or less of Mn was finishing rolled in the range of 650° C. to 800° C., and wound (coiling temperature=2000-2×finishing rolling temperature) in the range of 400° C. to 600° C., to produce a hot-rolled steel sheet having a yield point elongation of less than 1%. Further, it was disclosed that, at the rolling and coiling temperature, operable dislocations were non-uniformly introduced into ferrite, and the dislocations fixed by interstitial elements were prevented from a sudden shift, such that the dislocations were shifted by the external stress, to allow a continuous yield to occur, rather than a discontinuous yield. On the other hand, it is considered that, since the above temperature range is not preferable for producing a high strength thin steel sheet having a high plate shape and dimensional accuracy, a frequency of occurrence of shape defects of a steel sheet is higher, as a coiling temperature is lower.

From a review of the alloying components and the manufacturing process proposed in the above patent documents, there has been no proposal to manufacture a high-strength hot-rolled steel sheet containing 0.03 to 0.06% of carbon (C) and being excellent in terms of workability, even through conventional hot-rolling processes.

DISCLOSURE

Technical Problem

An aspect of the present disclosure may provide a hot-rolled steel sheet having excellent workability and a method of manufacturing the same.

Technical Solution

According to an aspect of the present disclosure, a hot-rolled coated steel sheet having a yield point elongation of less than 4%, comprising a hot-rolled steel sheet and a coated layer formed on a surface of the hot-rolled steel sheet, wherein the hot-rolled steel sheet comprises, by weight, 0.03 to 0.06% of carbon (C), 0.5 to 1.5% of manganese (Mn), 0.01 to 0.25% of silicon (Si), 0.01 to 0.05% of aluminum (Al), 0.001 to 0.02% of phosphorus (P), 0.006% or less of sulfur (S), 0.0001 to 0.02% of titanium (Ti), 0.0001 to 0.03% of niobium (Nb), 0.001 to 0.005% of nitrogen (N), and a balance of iron (Fe) and inevitable impurities, wherein the Ti, Al and N satisfy the following relationship 1, and the Nb, C and N satisfy the following relationship 2:

$$0.03 \leq (\text{wt \% Ti}) \times (\text{wt \% Al}) \times (\text{wt \% N}) \times 10^6 \leq 0.20 \quad (1)$$

$$22 \leq (\text{mol \% Nb})/\{(\text{mol \% C}) \times (\text{mol \% N})\} \leq 1826 \quad (2)$$

(wherein each of the values within parentheses in relationship 1 refers to a value of weight % of the respective corresponding element, and each of the values within parentheses in relationship 2 represents a value obtained by dividing the weight % of the respective corresponding element by the atomic weight of the respective corresponding element).

According to an aspect of the present disclosure, disclosed is a manufacturing method for a hot-rolled coated steel sheet, comprising: continuously casting ingot steel to obtain a slab, reheating the slab to a temperature of 1150 to 1250° C., subjecting the reheated slab to finish rolling at 850 to 900° C. to obtain a hot-rolled steel sheet, cooling the hot-rolled steel sheet at a rate of 10° C./sec or more, coiling at a temperature of 550 to 650° C., and pickling and coating the wound hot-rolled steel sheet to obtain a hot-rolled steel sheet, wherein the ingot steel comprises, by weight, 0.03 to 0.06% of carbon (C), 0.5 to 1.5% of manganese (Mn), 0.01 to 0.25% of silicon (Si), 0.01 to 0.05% of aluminum (Al), 0.001 to 0.02% of phosphorus (P), 0.006% or less of sulfur (S), 0.0001 to 0.02% of titanium (Ti), 0.0001 to 0.03% of niobium (Nb), 0.001 to 0.005% of nitrogen (N), and a balance of iron (Fe) and inevitable impurities, wherein the Ti, Al and N satisfy the following relationship 1, and the Nb, C and N satisfy the following relationship 2:

$$0.03 \leq (\text{wt \% Ti}) \times (\text{wt \% Al}) \times (\text{wt \% N}) \times 10^6 \leq 0.20 \quad (1)$$

$$22 \leq (\text{mol \% Nb}) / \{(\text{mol \% C}) \times (\text{mol \% N})\} \leq 1826 \quad (2)$$

(wherein each of the values within parentheses in relationship 1 refers to a value of weight % of the respective corresponding element, and each of the values within parentheses in relationship 2 represents a value obtained by dividing the weight % of the respective corresponding element by the atomic weight of the respective corresponding element).

In addition, the solution of the above-mentioned problems does not list all the features of the present invention. The various features of the present invention and the advantages and effects thereof will be more fully understood by reference to the following specific embodiments.

Advantageous Effects

According to an aspect of the present disclosure, it is possible to provide an excellent hot-rolled steel sheet excellent in workability.

BEST MODE FOR INVENTION

Figure 1:
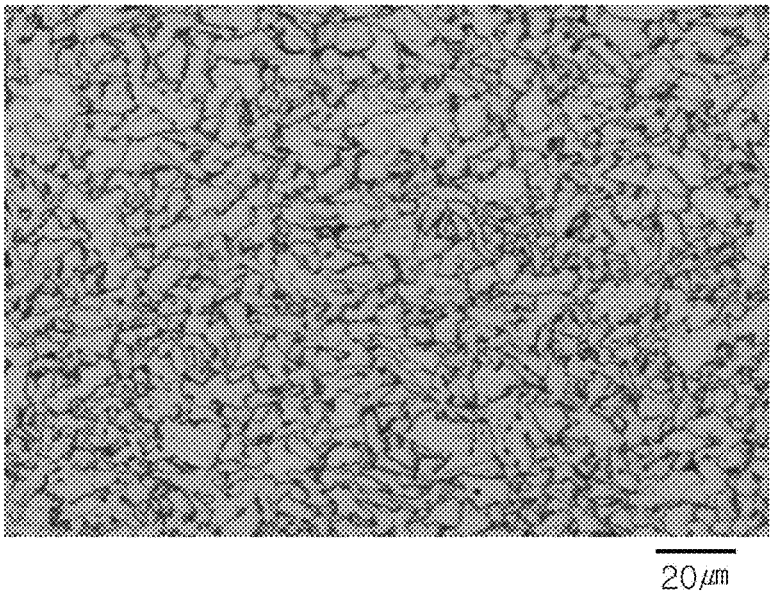
FIG. 1 is (a) a Scanning Electron Microscope (SEM) image of a microstructure of Inventive Example 1, and (b) a Scanning Electron Microscope (SEM) image of a microstructure of Inventive Example 2.
Figure 1:
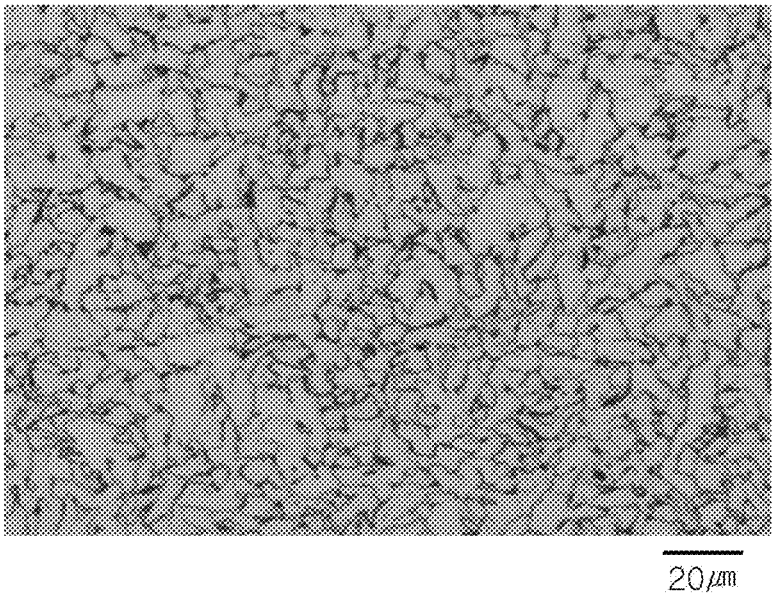

Hereinafter, a hot-rolled coated steel sheet having excellent workability, which is one aspect of the present invention, will be described in detail.

A hot-rolled coated steel sheet as one aspect of the present invention includes a hot-rolled steel sheet, and a coated layer formed on one or both surfaces of the hot-rolled steel sheet. In the present invention, the specific type of the coated layer is not particularly limited. For example, the coated layer may be a hot-dip coated layer, such as a hot-dip zinc-based coated layer or a hot-dip aluminum-based coated layer, comprising one or more selected from the group consisting of Zn and Al.

Hereinafter, alloying components and preferable content ranges of the hot-rolled steel sheet will be described in detail. It is to be noted in advance that the content of each component described below is on a weight basis, unless otherwise specified.

Carbon (C): 0.03 to 0.06%

Carbon is an element that forms carbides in steel, or may be dissolved in ferrite to improve strength of a hot-rolled steel sheet. To secure desired yield strength in the present invention, it may be preferable that an amount thereof be 0.03% or more. When an amount thereof is excessively high, it may be advantageous in securing yield strength, but may be disadvantageous due to an elongation thereof being lowered. Further, a carbonitride may be excessively formed in a ferrite grain boundary system to prevent movement of operable dislocations. In this case, since a yield point elongation thereof may be caused in a hot-rolled coated steel sheet, a surface level difference such as wrinkles may be generated on a surface of the hot-rolled coated steel sheet. To prevent this, it may be preferable that an amount thereof be 0.06% or less.

Manganese (Mn): 0.5 to 1.5%

Manganese may increase strength of a steel sheet by delaying a ferrite transformation. To secure desired strength in the present invention, it may be preferable to be contained in an amount of 0.5% or more. When an amount thereof is excessively high, workability may be deteriorated due to an excessive increase in strength, and cracks may be generated during the press working in a complicated shape. To prevent this, it may be preferable that an amount thereof be 1.5% or less.

Silicon (Si): 0.01 to 0.25%

Silicon may improve ductility of a steel sheet by enhancing a ferrite solid solution strengthening and a carbide formation, to increase stability of a residual austenite. To exhibit such effects in the present invention, it may be preferable that an amount thereof be 0.001% or more. When an amount thereof is excessively high, it may cause a pickling resistant scale defect to lower a surface quality of a hot-rolled steel sheet, and generate a bare spot at the time of hot-dip coating. To prevent a deterioration of the surface quality and an occurrence of the bare spot, it may be preferable that an amount thereof be 0.25% or less.

Aluminum (Al): 0.01 to 0.05%

Aluminum is an element that may react with oxygen in a steel sheet to improve a cleanliness of the steel sheet, suppress a formation of carbides in the steel sheet, increase stability of a residual austenite, and improve ductility of the steel sheet. To secure such effects in the present invention, it may be preferable that an amount thereof be 0.01% or more. When an amount thereof is excessively high, AlN may be formed by reacting with nitrogen in the steel, and edge crack defects of the hot-rolled steel sheet may be caused. To prevent this, it may be preferable that an amount thereof be 0.05% or less.

Phosphorus (P): 0.001 to 0.015%

Phosphorus is an element that may improve strength of a steel sheet. To exhibit such an effect in the present invention, it may be preferable that an amount thereof be 0.001% or more. When an amount thereof is excessively high, workability of the steel sheet may deteriorate. To prevent this, it may be preferable that an amount thereof be 0.015% or less.

Sulfur (S): 0.006% or Less

Sulfur is an element that may be an inevitably contained impurity in a steel sheet, which causes surface defects on a slab, and causes deteriorations of ductility and weldability of the steel sheet. Theoretically, it may be advantageous to limit the sulfur content to 0%. Sulfur may be inevitably contained inevitably in a manufacturing process. Therefore, it may be important to manage an upper limit, and in the present invention, the upper limit of the sulfur content may be controlled to be 0.006%.

Titanium (Ti): 0.0001 to 0.02%

Titanium is a carbonitride-forming element, and is an element that may increase strength of a steel sheet. To exhibit such an effect in the present invention, it may be preferable that an amount thereof be 0.0001% or more. When an amount thereof is excessively high, manufacturing costs may be increased, and the ductility of the steel sheet may be deteriorated. To prevent this, it may be preferable that an amount thereof be 0.02% or less.

Niobium (Nb): 0.0001 to 0.03%

Niobium is an element that may form carbonitrides and refine austenite grains at high temperature. To exhibit such an effect in the present invention, it may be preferable that an amount thereof be 0.0001% or more. When an amount thereof is excessively high, the deformation resistance of a steel sheet during the hot rolling may be excessively increased, which may make it difficult to manufacture the hot-rolled steel sheet. To prevent this, it may be preferable that an amount thereof be 0.03% or less.

Nitrogen (N): 0.001 to 0.01%

Nitrogen is an element that may stabilize austenite and form nitride. To exhibit such effects in the present invention, it may be preferable that an amount thereof be 0.001% or more. When an amount thereof is excessively high, AlN may be formed in a steel sheet to cause a crack defect in a slab. To prevent such a crack defect in a slab, it may be preferable that an amount thereof be 0.01% or less.

In addition to the above composition, a remainder may be Fe. Since impurities that are not intended, from raw materials or the surrounding environment, may be inevitably incorporated in a conventional manufacturing process, the impurities may not be excluded. The impurities are not specifically mentioned in this specification, as they are known to one of ordinary skill in the art. On the other hand, the addition of an effective component other than the above-mentioned composition may be not excluded.

Since copper (Cu), chrome (Cr), nickel (Ni), molybdenum (Mo), boron (B), tin (Sn) and calcium (Ca) correspond to typical impurities which should be significantly reduced to secure a surface quality of a hot-rolled coated steel sheet, the following description will briefly be described.

Copper (Cu), Chrome (Cr), Nickel (Ni), Molybdenum (Mo), Boron (B), Tin (Sn) and Calcium (Ca): 0.03% or Less in Total Tramp elements (copper (Cu), chrome (Cr), nickel (Ni), molybdenum (Mo), boron (B), tin (Sn) and calcium (Ca)) may be an impurity element originated from scrap used as a raw material in a steelmaking process. When an amount thereof is excessively high, ultra-fine oxides may be formed on a surface of a hot-rolled steel sheet, and such ultra-fine oxides remain even after pickling, to deteriorate the coating ability at the time of hot-dip coating. In this case, there may be a variation in the amount of coating deposition, which may result in honeycomb or tear-like surface defects, so-called tear mark defects. To prevent this, it may be preferable to control the sum of the tramp element contents to 0.03% or less.

When designing an alloy of a steel material having the above-described composition range, it may be preferable that the titanium (Ti), aluminum (Al) and nitrogen (N) satisfy the following relationship 1, and niobium (Nb), carbon (C) and nitrogen (N) satisfy the following relationship 2. When the following relationship 1 or 2 may be not satisfied, workability may deteriorate due to a yield point elongation.

$$0.03 \leq (\text{wt \% Ti}) \times (\text{wt \% Al}) \times (\text{wt \% N}) \times 10^6 \leq 0.20 \quad (1)$$

$$22 \leq (\text{mol \% Nb}) / \{(\text{mol \% C}) \times (\text{mol \% N})\} \leq 1826 \quad (2)$$

(wherein each of the value within parentheses in relationship 1 refers to a value of weight % of the respective corresponding element, and each of the values within parentheses in relationship 2 represents a value obtained by dividing the weight % of the respective corresponding element by the atomic weight of the respective corresponding element).

The hot-rolled coated steel sheet of the present invention may contain ferrite as a main phase, and may be substantially formed of ferrite alone.

According to one example, a fraction of ferrite having an aspect ratio (short axis distance/long axis distance) of 0.2 to 0.8 in ferrite may be 85% or more. When the fraction may be less than 85%, a structural uniformity may be lowered, and workability may be deteriorated.

According to one example, an average circle equivalent diameter of ferrite may be less than 5 μm. When an average circle equivalent diameter may be 5 μm or more, strength of a coated steel sheet may be increased, and ductility of a coated steel sheet may be deteriorated, or yield point elongation may be increased to add a process such as application of Skin Pass Milling (SPM).

According to one example, a circle equivalent diameter of ferrite having a cumulative area percentage of 95 area % may be 18 m or less. When the circle equivalent diameter exceeds 18 μm, it may be difficult to secure sufficient strength.

The hot-rolled steel sheet of the present invention has an advantage of excellent processability, and the hot-rolled steel sheet of the present invention has a yield point elongation of less than 4%.

In addition, the hot-rolled steel sheet of the present invention has an advantage of high yield strength and yield ratio. According to an example, it may have a yield strength of 300 MPa or more, and a yield ratio (yield strength/tensile strength) of 0.8 or more.

In addition, the hot-rolled steel sheet of the present invention may be advantageous, in that a deviation in material may be small. According to one example, the hot-rolled steel sheet may have a tensile strength deviation of 20 MPa or less (including 0 MPa) in a width direction of the hot-rolled steel sheet. In this case, the tensile strength or hardness deviation means a difference between a tensile strength of the hot-rolled steel sheet at a central portion in the width direction and a tensile strength of the hot-rolled steel sheet at a position spaced 10 mm from an edge portion in the width direction to a central portion in the width direction.

In addition, the hot-rolled coated steel sheet of the present invention may be advantageous, in that a thickness deviation may be small. According to an example, a thickness tolerance of 50 μm or less (including 0 μm) in the width direction of the hot-rolled steel sheet may be obtained. At this time, the thickness tolerance means a difference between a thickness of the hot-rolled steel sheet at a central portion in the width direction, and a thickness of the hot-rolled steel sheet at a position spaced 10 mm from an edge portion to a central portion, in the width direction.

The hot-rolled coated steel sheet of the present invention described above may be produced by various methods, and the production method thereof is not particularly limited. As an embodiment, it may be produced by the following method.

Hereinafter, a method of manufacturing a hot-rolled coated steel sheet having excellent workability, which may be another aspect of the present invention, will be described in detail.

First, after preparing ingot steel satisfying the above-described alloying composition, a slab may be obtained by continuous casting. According to one example, a casting speed of the slab during the continuous casting may be 1.1 mpm (meter per minute) or higher.

Next, the slab may be reheated.

At this time, a temperature reheating the slab may preferably be 1150 to 1250° C. When the slab reheating temperature is less than 1150° C., precipitates are not sufficiently subjected to a solid solution again, to reduce precipitates such as NbC, (Ti, Nb)CN, and the like, in a process after hot-rolling. On the other hand, when the slab reheating temperature exceeds 1250° C., strength may be lowered by austenite grain growth.

Next, the reheated slab may be subjected to finish rolling to obtain a hot-rolled steel sheet.

At this time, the finishing rolling temperature may preferably be 850 to 900° C. When the finish rolling temperature is less than 850° C., an edge portion of a hot-rolled strip may be excessively cooled, and coarse and fine ferrite grains may be mixed, to cause uneven strength. On the other hand, when the finish rolling temperature exceeds 900° C., ferrite crystal grains may be roughed, or a scale defect may occur on the surface of the hot-rolled strip.

According to one example, a Crown 25 value of the hot-rolled steel sheet may be 40 μm or less. The Crown 25 value means a difference between a thickness of the hot-rolled steel sheet at a central portion in the width direction and a thickness of the hot-rolled steel sheet at a position spaced 25 mm from an edge portion to a central portion, in the width direction. In the present invention, a specific method for controlling the Crown 25 value is not particularly limited. For example, by controlling an angle of upper and lower rolls to a constant range, to perform Pair Cross Rolling, the Crown 25 value of the above range may be obtained.

Next, the hot-rolled steel sheet may be cooled and then wound.

At this time, a cooling rate may preferably be 10° C./sec or more. When the cooling rate may be less than 10° C., a ferrite grain size may increase, or cementite on the ferrite grain boundaries may excessively precipitate, to decrease strength of the hot-rolled steel sheet.

The coiling temperature may preferably be 550 to 650° C. When the coiling temperature is lower than 550° C., irregularly shaped ferrite grains may be formed, and non-uniformity of microstructures may be increased. On the other hand, when the coiling temperature exceeds 650° C., it may be difficult to secure strength due to roughening of grains, and internal oxidation of the steel sheet may be promoted to cause surface-scale defects.

Next, the wound hot-rolled steel sheet may be pickled and coated to obtain a hot-rolled coated steel sheet.

When the coating process is a hot-dip zinc-based coating process, before coating process after the pickling process, the hot-rolled steel sheet may be heated to 450° C. to 550° C., and then subjected to an isothermal temperature heat treatment at 500° C. to 560° C.

When the heating temperature of the wound hot-rolled steel sheet may be less than 450° C., the frequency of occurrence of coating defects (tear marks) may be increased due to insufficient heating. When the heating temperature exceeds 550° C., coated surface defects due to color differences on the surface of the coated layer may occur. In addition, the isothermal temperature heat treatment may be for uniform distribution of alloying elements, and alloying of a coated layer. When the temperature is less than 500° C., the above effect may be difficult to obtain. Further, there may be a disadvantage in that surface defects of a coated layer, such as flow patterns, may be generated. Fe—Zn alloying occurring at a base steel interface, adjacent to a base steel/coated layer interface, may be uneven, which may result in a difference in colors of the coated layer.

MODE FOR INVENTION

Hereinafter, the present invention will be described in more detail with reference to examples. The description of these embodiments may be for the purpose of illustrating the practice of the present invention, but the present invention is not limited by the description of these embodiments. The scope of the present invention may be determined by the matters described in the claims and the matters able to be reasonably deduced therefrom.

The slabs having the compositions shown in the following Table 1 were prepared, and then subjected to reheating and finish rolling under the conditions shown in Table 2 to prepare hot-rolled steel sheets, which were then cooled and wound. Thereafter, the wound hot-rolled steel sheets were pickled, heated to 480° C., subjected to an isothermal temperature heat treatment at 520° C., and immersed in a hot dip galvanizing bath (coating bath composition: 0.11 to 0.5% by weight of Al, and a remainder being Zn) at 460° C. to produce a hot-rolled coated steel sheet.

Thereafter, a microstructure of the steel sheet was analyzed for the thus-prepared hot-rolled coated steel sheet, and the results are shown in Table 2 below. Further, the materials are measured, and the results were shown in Table 3 below. In this case, the material of the steel sheet was measured by taking an ASTM specimen in a direction parallel to the rolling direction at a quarter point in the width direction, and the material characteristic deviation of the steel sheet was obtained by measuring the ASTM specimen in a direction parallel to the rolling direction at a central portion in the width direction, and at a position spaced 10 mm from an edge portion in the width direction to a central portion in the width direction, respectively, and determining a difference between the measured values. Meanwhile, In Table 2, YS, TS, E1 and YR mean yield strength, tensile strength, elongation and yield ratio, respectively.

TABLE 1

| Type | Compositional Range(weight %) | | | | | | | | | | | |
|---|---|---|---|---|---|---|---|---|---|---|---|---|
| | C | Mn | Si | P | S | Al | Nb | Ti | N | Tramp Elements | Relationship 1 | Relationship 2 |
| Inventive Steel 1 | 0.052 | 0.780 | 0.045 | 0.0073 | 0.0035 | 0.034 | 0.008 | 0.001 | 0.0040 | 0.030 | 0.14 | 70 |
| Inventive Steel 2 | 0.039 | 0.850 | 0.052 | 0.0100 | 0.0016 | 0.010 | 0.010 | 0.001 | 0.0042 | 0.030 | 0.03 | 111 |
| Inventive Steel 3 | 0.043 | 0.780 | 0.056 | 0.0100 | 0.0016 | 0.030 | 0.009 | 0.001 | 0.0040 | 0.030 | 0.12 | 96 |
| Inventive Steel 4 | 0.048 | 0.900 | 0.039 | 0.0096 | 0.0016 | 0.024 | 0.015 | 0.001 | 0.0059 | 0.030 | 0.11 | 97 |
| Comparative Steel 1 | 0.043 | 1.020 | 0.047 | 0.0190 | 0.0032 | 0.083 | 0.001 | 0.038 | 0.0069 | 0.070 | 21.76 | 6 |
| Comparative Steel 2 | 0.080 | 1.120 | 0.205 | 0.0190 | 0.0040 | 0.027 | 0.035 | 0.002 | 0.0037 | 0.040 | 0.20 | 216 |
| Comparative Steel 3 | 0.044 | 0.836 | 0.048 | 0.0120 | 0.0010 | 0.014 | 0.010 | 0.009 | 0.0066 | 0.080 | 0.83 | 63 |

TABLE 2

| Type of Steel | Production Condition | | | | | Microstructure | | Etc |
|---|---|---|---|---|---|---|---|---|
| | Reheating Temperature (° C.) | Finish Rolling Temperature (° C.) | Cooling Rate (° C./s) | Crown 25 (mm) | Winding Temperature (° C.) | Fraction of Ferrite having an Aspect ratio of 0.2 to 0.8 (%) | Average Circle Equivalent Diameter (μm) | |
| Inventive Steel 1 | 1202 | 866 | 20 | 40 | 578 | 87 | 3.91 | Inventive Example 1 |
| | 1205 | 886 | 15 | 40 | 610 | 88 | 3.67 | Inventive Example 2 |
| Inventive Steel 2 | 1219 | 885 | 15 | 40 | 589 | 88 | 3.73 | Inventive Example 3 |
| | 1212 | 869 | 15 | 40 | 582 | 89 | 4.09 | Inventive Example 4 |
| | 1204 | 870 | 15 | 70 | 580 | 87 | 3.87 | Inventive Example 5 |
| | 1177 | 887 | 15 | 19 | 584 | 88 | 3.73 | Inventive Example 6 |
| | 1200 | 891 | 15 | 27 | 580 | 88 | 3.73 | Inventive Example 7 |
| | 1204 | 872 | 15 | 32 | 565 | 87 | 3.94 | Inventive Example 8 |
| Inventive Steel 3 | 1217 | 884 | 15 | 27 | 582 | 89 | 3.78 | Inventive Example 9 |
| Inventive Steel 4 | 1190 | 899 | 20 | 41 | 562 | 90 | 3.92 | Inventive Example 10 |
| Comparative Steel 1 | 1200 | 870 | 10 | 83 | 650 | 85 | 7.38 | Comparative Example 1 |
| Comparative Steel 2 | 1180 | 870 | 15 | — | 620 | 92 | 3.65 | Comparative Example 2 |
| Comparative Steel 3 | 1100 | 863 | 15 | 92 | 625 | 89 | 5.09 | Comparative Example 3 |

TABLE 3

| Type of Steel | Mechanical Properties | | | | | Tensile Strength Deviation (MPa) | Thickness Tolerance (mm) | Etc |
|---|---|---|---|---|---|---|---|---|
| | YS (MPa) | TS (MPa) | El (%) | YR | Yield Point Elongation (%) | | | |
| Inventive Steel 1 | 391 | 469 | 28 | 0.83 | 1.9 | 11 | 0.020 | Inventive Example 1 |
| | 400 | 467 | 31 | 0.86 | 3.2 | 20 | 0.050 | Inventive Example 2 |

TABLE 3-continued

| Type of Steel | Mechanical Properties YS (MPa) | TS (MPa) | El (%) | YR | Yield Point Elongation (%) | Tensile Strength Deviation (MPa) | Thickness Tolerance (mm) | Etc |
|---|---|---|---|---|---|---|---|---|
| Inventive Steel 2 | 429 | 480 | 25 | 0.89 | 3.0 | 15 | 0.025 | Inventive Example 3 |
| | 428 | 481 | 25 | 0.89 | 2.6 | 15 | 0.012 | Inventive Example 4 |
| | 432 | 482 | 26 | 0.90 | 3.1 | 16 | 0.075 | Inventive Example 5 |
| | 413 | 474 | 29 | 0.87 | 2.5 | 18 | 0.010 | Inventive Example 6 |
| | 413 | 473 | 29 | 0.87 | 1.8 | 13 | 0.050 | Inventive Example 7 |
| | 423 | 473 | 30 | 0.89 | 3.1 | 20 | 0.025 | Inventive Example 8 |
| Inventive Steel 3 | 459 | 513 | 24 | 0.89 | 1.8 | 12 | 0.045 | Inventive Example 9 |
| Inventive Steel 4 | 432 | 482 | 26 | 0.90 | 3.1 | 20 | 0.075 | Inventive Example 10 |
| Comparative Steel 1 | 370 | 409 | 31 | 0.90 | 6.0 | 22 | 0.030 | Comparative Example 1 |
| Comparative Steel 2 | 463 | 510 | 32 | 0.91 | 4.5 | 23 | 0.016 | Comparative Example 2 |
| Comparative Steel 3 | 399 | 464 | 33 | 0.86 | 4.2 | 23 | 0.022 | Comparative Example 3 |

* The thickness tolerance was measured on a hot-rolled steel sheet before plating Referring to Table 3, it may be confirmed that yield ratios of 0.8 or more, yield strengths of 300 MPa or more, and yield point elongations of less than 4% are shown in Inventive Examples 1 to 10.

FIG. 1A is a Scanning Electron Microscope (SEM) image of a microstructure of Inventive Example 1, and FIG. 1B is a Scanning Electron Microscope (SEM) image of a microstructure of Inventive Example 2.

Figure 2:
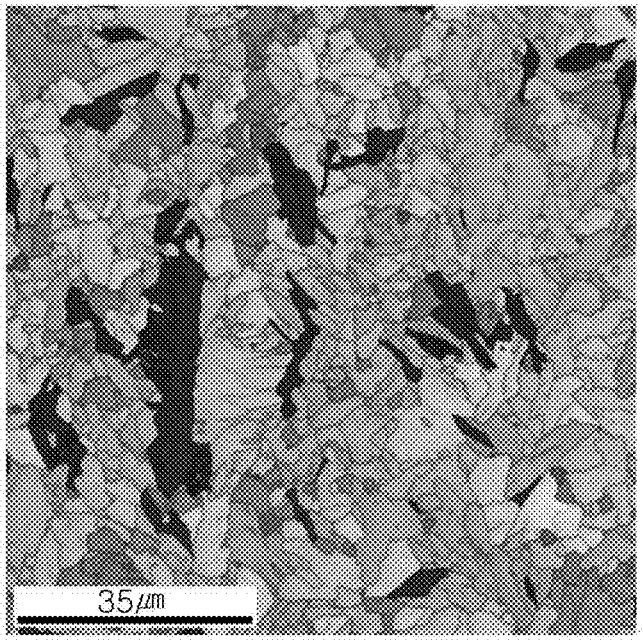
FIG. 2 is (a) an Electron Back-Scatter Diffractometer (EBSD) image of Inventive Example 1, and (b) an Electron Back-Scatter Diffractometer (EBSD) image of Inventive Example 2.
Figure 2:
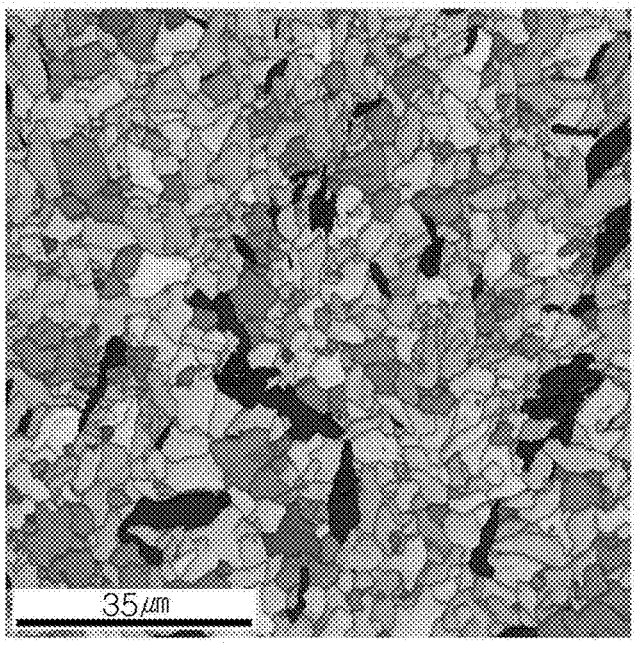

FIG. 2A is an Electron Back-Scatter Diffractometer (EBSD) image of Inventive Example 1, and FIG. 2B is an Electron Back-Scatter Diffractometer (EBSD) image of Inventive Example 2. In FIG. 2, a blue portion represents a ferrite grain having an aspect ratio of 0.10 or more and less than 0.30, a green portion represents a ferrite grain having an aspect ratio of 0.30 or more and less than 0.45, a yellow region represents a ferrite grain having an aspect ratio of 0.45 or more and less than 0.60, an orange region represents a ferrite grain having an aspect ratio of 0.60 or less and less than 0.70, and a red region represents a ferrite grain having an aspect ratio of 0.70 or more and 0.90 or less.

Figure 3:
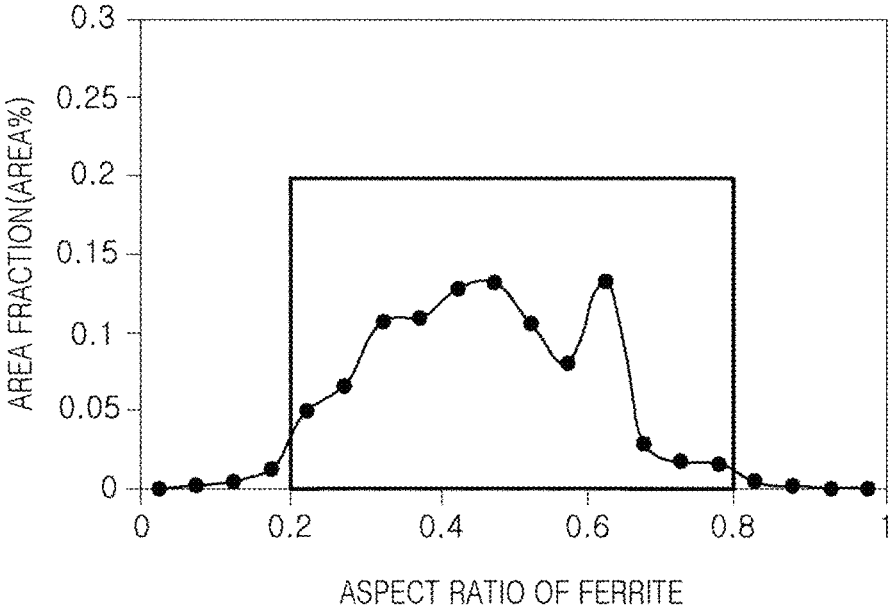
FIG. 3 is (a) a graph illustrating an area fraction of ferrite according to an aspect ratio of ferrite of Inventive Example 1, and (b) a graph illustrating an area fraction of ferrite according to an aspect ratio of ferrite of Inventive Example 2.
Figure 3:
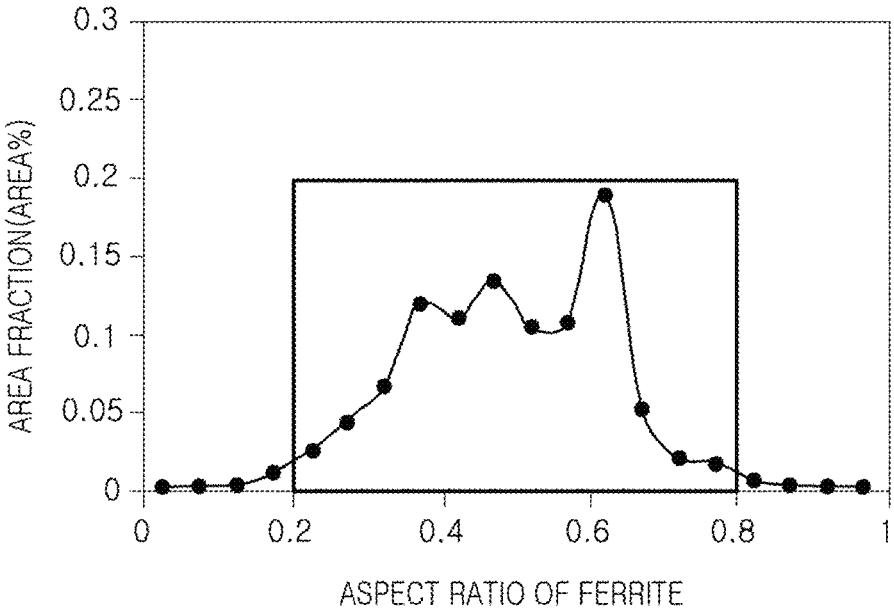

FIG. 3A is a graph illustrating an area fraction of ferrite according to an aspect ratio of ferrite of Inventive Example 1, and FIG. 3B is a graph illustrating an area fraction of ferrite according to an aspect ratio of ferrite of Inventive Example 2. Referring to FIG. 3, it may be confirmed that the aspect ratio of most of the ferrite grains may be 0.2 to 0.8.

Figure 4:
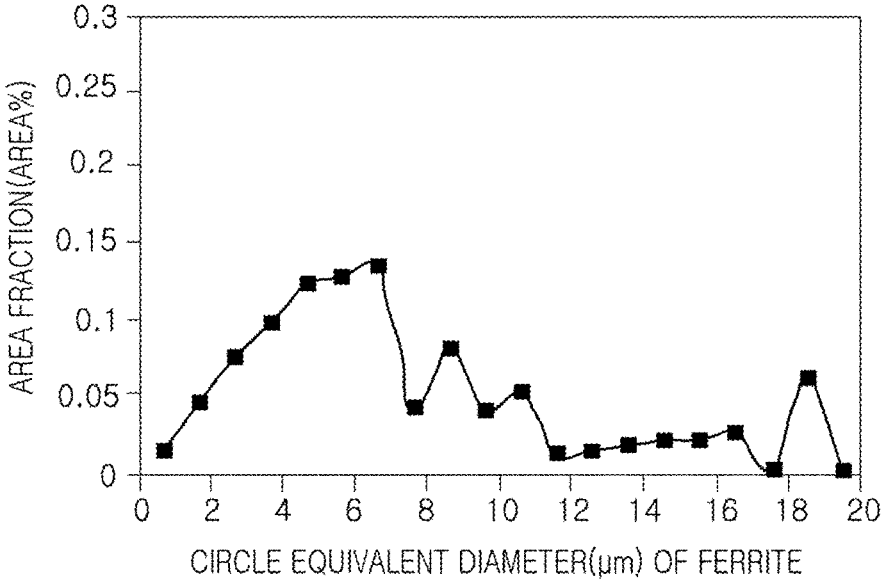
FIG. 4 is (a) a graph illustrating an area fraction of ferrite according to a circle equivalent diameter of ferrite of Inventive Example 1, and (b) a graph illustrating an area fraction of ferrite according to a circle equivalent diameter of ferrite of Inventive Example 2.
Figure 4:
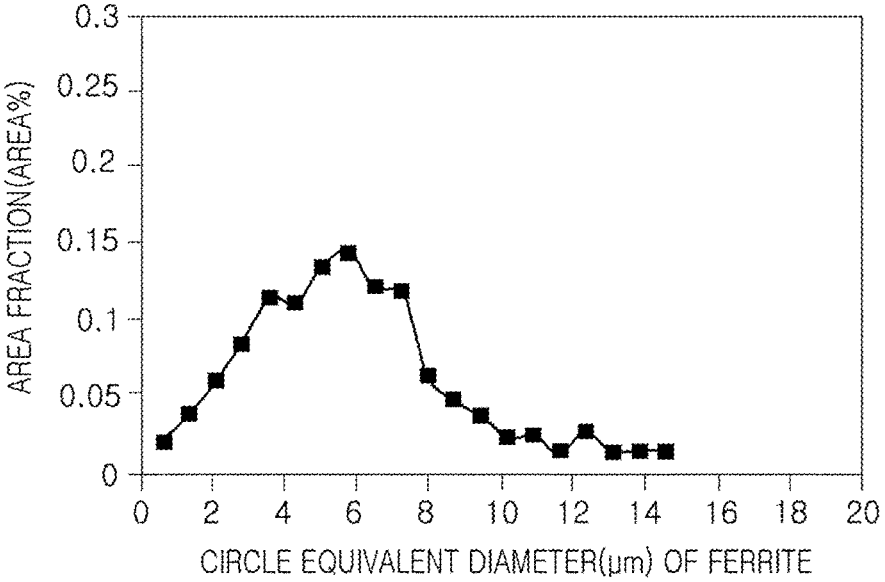

FIG. 4A is a graph illustrating an area fraction of ferrite according to a circle equivalent diameter of ferrite of Inventive Example 1, and FIG. 4B is a graph illustrating an area fraction of ferrite according to a circle equivalent diameter of ferrite of Inventive Example 2. Referring to FIG. 4, it may be confirmed that most of the ferrite grains have a circle equivalent diameter of 18 μm or less.

Figure 5:
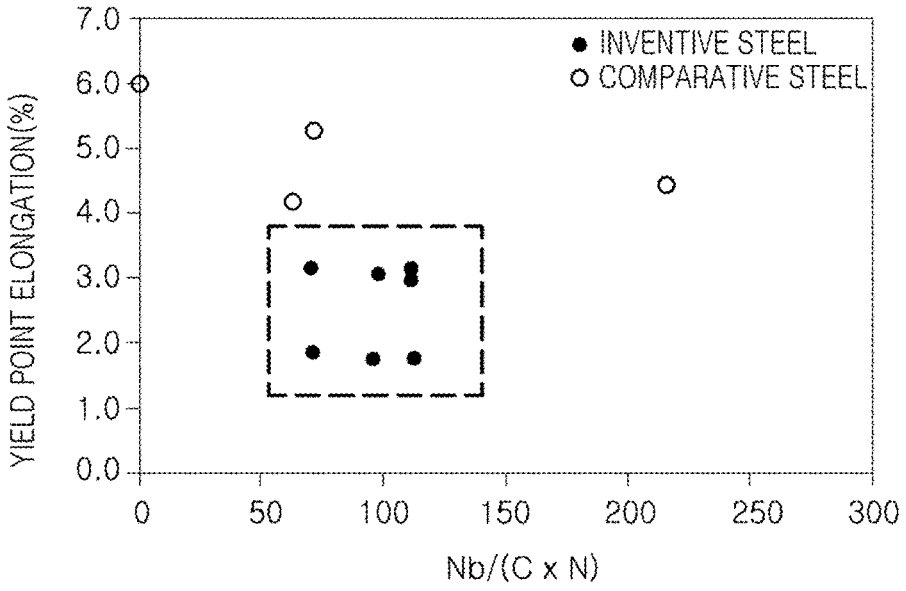
FIG. 5 is (a) a graph illustrating a relationship of yield point elongation according to values of relationship 2 of Inventive Examples and Comparative Examples, and (b) a graph illustrating a yield strength according to a yield point elongation of Inventive Examples and Comparative Examples.
Figure 5:
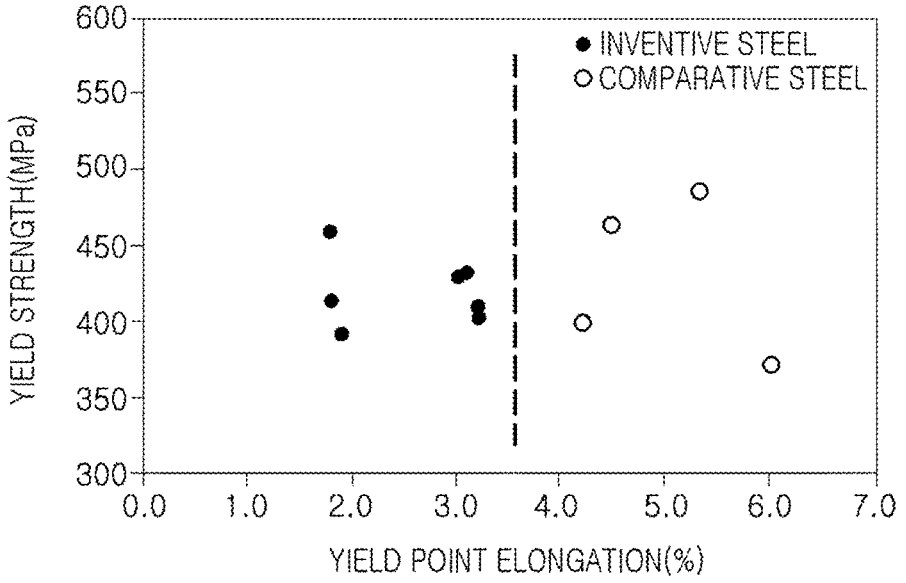

FIG. 5A is a graph illustrating a relationship of yield point elongation according to values of relationship 2 of Inventive Examples and Comparative Examples, and FIG. 5B is a graph illustrating a yield strength according to a yield point elongation of Inventive Examples and Comparative Examples.

While exemplary embodiments have been shown and described above, it will be apparent to those skilled in the art that modifications and variations could be made without departing from the scope of the present invention as defined by the appended claims.

The invention claimed is:

1. A hot-rolled coated steel sheet having a yield point elongation of less than 4%, comprising a hot-rolled steel sheet and a coated layer formed on a surface of the hot-rolled steel sheet, wherein the hot-rolled steel sheet comprises, by weight, 0.03 to 0.06% of carbon (C), 0.5 to 1.5% of manganese (Mn), 0.01 to 0.25% of silicon (Si), 0.01 to 0.05% of aluminum (Al), 0.001 to 0.02% of phosphorus (P), 0.006% or less of sulfur (S), 0.0001 to 0.02% of titanium (Ti), 0.0001 to 0.03% of niobium (Nb), 0.001 to 0.005% of nitrogen (N), and a balance of iron (Fe) and inevitable impurities, wherein the inevitable impurities include copper (Cu), chromium (Cr), nickel (Ni), molybdenum (Mo), boron (B), tin (Sn), and calcium (Ca), and a total amount of the inevitable impurities is suppressed to 0.03% or less (including 0%), and wherein the Ti, the Al and the N satisfy the following relationship 1, and the Nb, the C and the N satisfy the following relationship 2:

$$0.03 \leq (\text{wt \% Ti}) \times (\text{wt \% Al}) \times (\text{wt \% N}) \times 10^6 \leq 0.20 \quad (1)$$

$$22 \leq (\text{mol \% Nb}) / \{(\text{mol \% C}) \times (\text{mol \% N})\} \leq 1826 \quad (2)$$

where each of the values within parentheses in relationship 1 refers to a value of weight % of the respective corresponding element, and each of the values within parentheses in relationship 2 represents a value obtained by dividing the weight % of the respective corresponding element by the atomic weight of the respective corresponding element.

2. The hot-rolled coated steel sheet according to claim 1, wherein the hot-rolled coated steel sheet comprises ferrite as a main phase.

3. The hot-rolled coated steel sheet according to claim 2, wherein a fraction of ferrite having an aspect ratio (short axis distance/long axis distance) of 0.2 to 0.84 is 85% or more with respect to a total amount of the ferrite.

4. The hot-rolled coated steel sheet according to claim 2, wherein an average circle equivalent diameter of the ferrite is less than 5 μm.

5. The hot-rolled coated steel sheet according to claim 2, wherein a circle equivalent diameter of ferrite having a cumulative area percentage of 95% by area is 18 μm or less.

6. The hot-rolled coated steel sheet according to claim 1, wherein the coated layer is a hot-dip coated layer, and comprises one or more selected from the group consisting of zinc (Zn) and aluminum (Al).

7. The hot-rolled coated steel sheet according to claim 1, further comprising a yield ratio (yield strength/tensile strength) of 0.8 or more.

8. The hot-rolled coated steel sheet according to claim 1, wherein the hot-rolled steel sheet has a thickness tolerance of 50 μm or less (including 0 μm) in a width direction.

* * * * *